US005833583A

United States Patent [19]

Chuang

[11] Patent Number: 5,833,583

[45] Date of Patent: Nov. 10, 1998

[54] EXERCISER HAVING FOOT SUPPORTS MOVING ALONG ELLIPTICAL PATH

[76] Inventor: Jin Chen Chuang, No. 17, Lane 301, Nan Yang Road, Feng Yuan City, Taichung Hsien, Taiwan

[21] Appl. No.: 14,097

[22] Filed: Jan. 27, 1998

[51] Int. Cl.[6] ..... A63B 21/22

[52] U.S. Cl. ..... 482/60; 482/57

[58] Field of Search ..... 482/51, 57, 60, 482/63

[56] References Cited

U.S. PATENT DOCUMENTS

| | | | |
|---|---|---|---|
| 3,100,640 | 8/1963 | Weitzel | 482/60 |
| 4,185,622 | 1/1980 | Swenson | 482/51 |
| 5,299,995 | 4/1994 | Ko | 482/60 |
| 5,352,169 | 10/1994 | Eschenbach | 482/57 |
| 5,383,829 | 1/1995 | Miller | 482/57 |
| 5,562,574 | 10/1996 | Miller | 482/52 |

*Primary Examiner*—Stephen R. Crow

[57] ABSTRACT

An exerciser includes a base, two gears secured on the base, and two plates rotatably secured to the base at an axle. Two pinions are rotatably secured to the plates and engaged with the gears. Two foot supports are slidably secured to and movable radially relative to the plates and each has a foot pedal and each has one end secured to the pinions at an eccentric shaft, for allowing the foot pedals to be moved toward and away from the axle and for allowing the foot pedals to be moved along an elliptic moving path when the foot supports are moved radially relative to the plates.

6 Claims, 4 Drawing Sheets

EXERCISER HAVING FOOT SUPPORTS MOVING ALONG ELLIPTICAL PATH

BACKGROUND OF THE INVENTION

1. Field of the Invention

The present invention relates to an exerciser, and more particularly to a stationary exerciser.

2. Description of the Prior Art

Typical stationary exercisers comprise a pair of foot pedals each having one or more wheels rotatably or slidably engaged with one or more tracks for allowing the foot pedals to move both upward and downward and forward and backward movements. U.S. Pat. No. 5,352,169 to Eschenbach and U.S. Pat. No. 5,383,829 to Miller disclose this type of stationary exercisers. However, the wheels may be disengaged from the tracks and may hurt the children inadvertently.

The present invention has arisen to mitigate and/or obviate the afore-described disadvantages of the conventional exercisers.

SUMMARY OF THE INVENTION

The primary objective of the present invention is to provide a stationary exerciser including a pair of movable foot supports for allowing the user to conduct a stepping exercise along an elliptical moving path.

In accordance with one aspect of the invention, there is provided an exerciser comprising a base including an axle, a pair of plates rotatably secured to the axle and adapted to be rotated about the axle, a pair of foot supports slidably secured to the plates and adapted to be moved radially relative to the plates, the foot supports each including a first end having a foot pedal, and means for moving the foot supports radially relative to the plates. The foot pedals are moved along an elliptic moving path when the foot supports are moved radially relative to the plates.

The base includes a pair of first circular members secured thereon at the axle, the plates each includes a first end having a second circular member rotatably secured thereon at a pivot pin and engaged with the first circular member and adapted to be rotated around the first circular member, for allowing the second circular member to be rotated about the pivot pin when the second circular member is rotated around the first circular member, the foot supports each includes a second end pivotally coupled to the second circular member at an eccentric shaft for allowing the second end of the foot supports to be rotated around the eccentric shaft when the second circular member is rotated around the first circular member.

The first circular member is a gear, and the second circular member is a pinion engaged with the gear. The first circular member is an internal gear, and the second circular member is a pinion engaged with the internal gear. The plates each includes a pair of rollers for slidably engaging with the foot supports. The base includes a handle for supporting an upper portion of a user.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
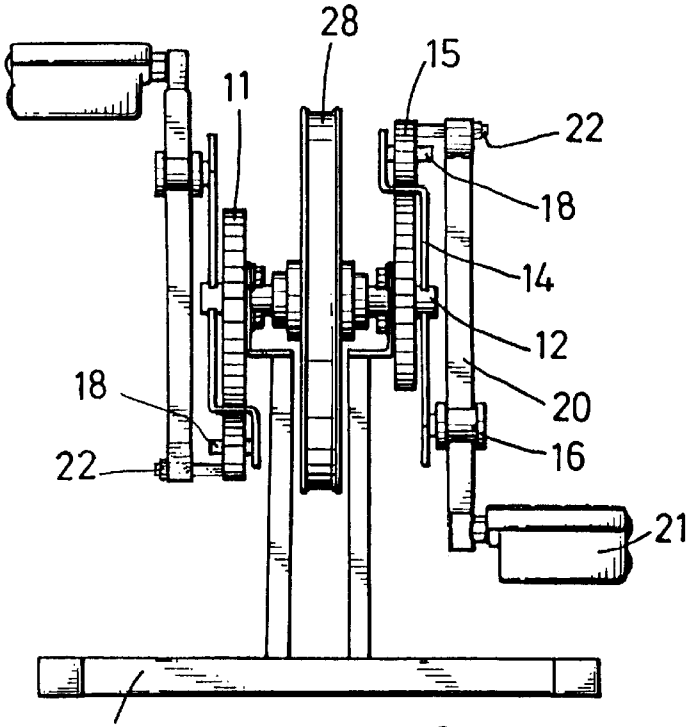
FIG. 2 is a front view of the exerciser.
Figure 1:
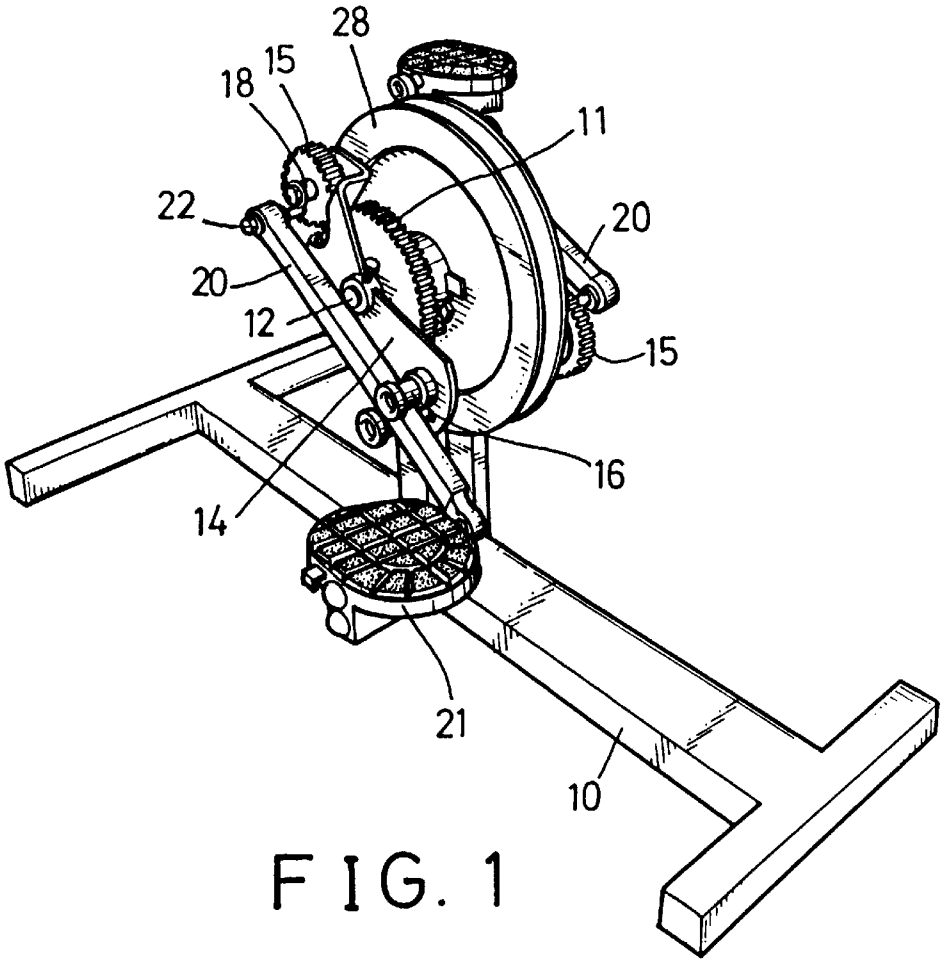
FIG. 1 is a perspective view of a stationary exerciser in accordance with the present invention.
Figure 3:
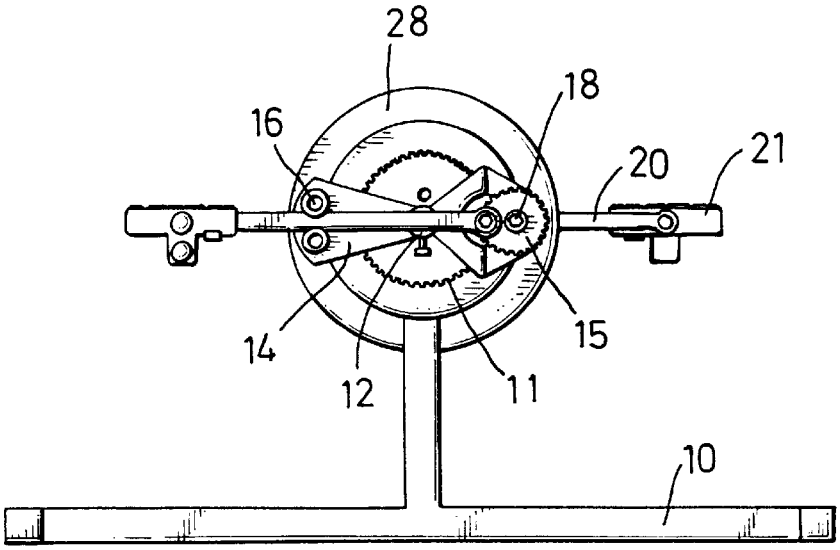
FIGS. 3 and 4 are side views illustrating the operation of the exerciser.

Referring to the drawings, and initially to FIGS. 1–3, a stationary exerciser in accordance with the present invention comprises a base 10 including a pair of circular members, such as gears 11 secured thereon. An axle 12 is solidly or rotatably secured to the centers of the gears 11. A pair of plates 14 are rotatably or solidly secured to the axle 12 for allowing the plates 14 to be rotated about the axle 12. The plates 14 each includes a pair of rollers 16 secured to one end and a pinion 15 rotatably secured to the other end at a pivot pin 18. The pinion 15 is engaged with the gear 11 for allowing the pinion 15 to be rotated about the pivot pin 18 when the pinion 15 is rotated around the peripheral portion of the gear 11.

A pair of foot supports 20 are slidably engaged with the rollers 16 and each includes a foot pedal 21 secured to one end and each includes the other end pivotally secured to the pinion 15 at an eccentric shaft 22. The shaft 22 may be rotated around the pivot pin 18 when the pinion 15 is rotated about the pivot pin 18 and when the pinion 15 is rotated around the gear 11, such that the foot supports 20 may be moved radially of the plate 14 and such that the foot pedals 21 may be moved radially toward or away from the axle 12.

Figure 4:
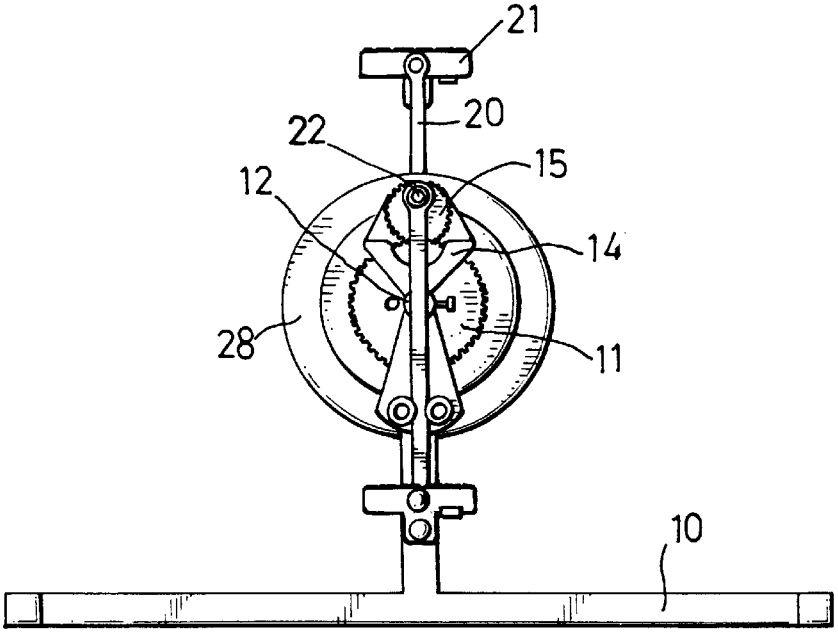

In operation, the foot pedals 21 may be moved to the forwardmost position and the rearmost position respectively when the foot supports 20 are rotated about the axle 12 to the horizontal position (FIG. 3), and the foot pedals 21 may be moved to the uppermost position and the lowermost position respectively when the foot supports 20 are rotated about the axle 12 to the perpendicular position (FIG. 4), such that the foot supports 20 and/or the foot pedals 21 may be moved along an elliptical path.

Figure 5:
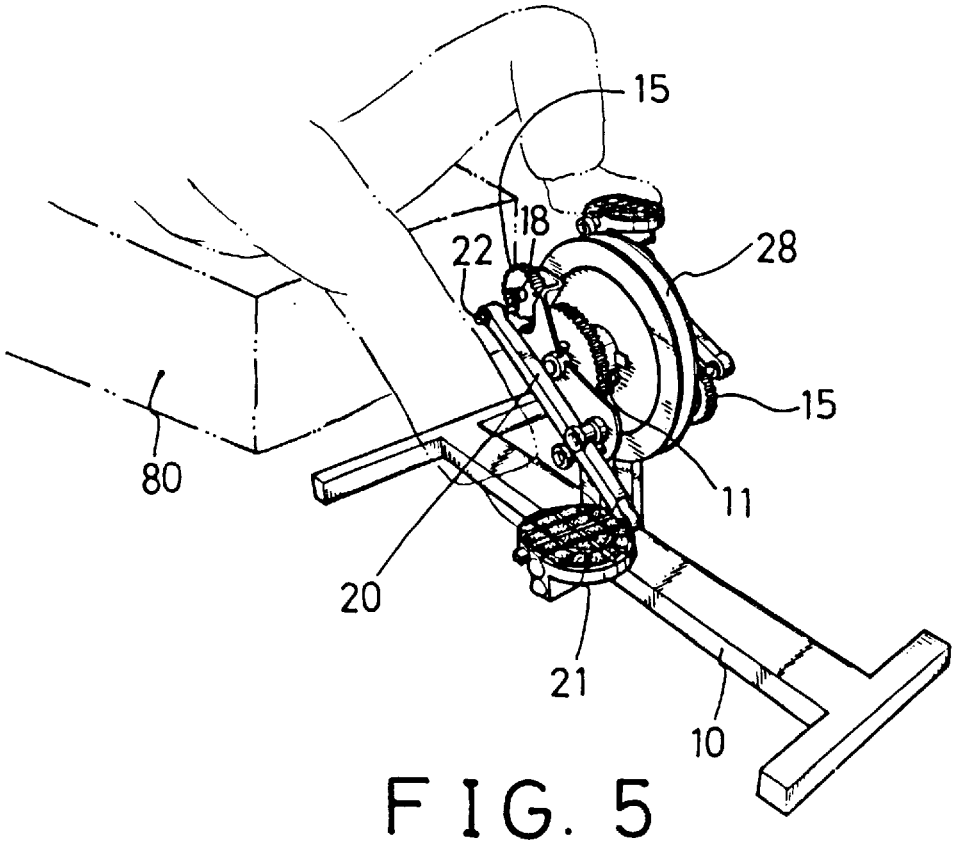
FIGS. 5, 6, 7 are perspective views illustrating the applications of the exerciser.
Figure 6:
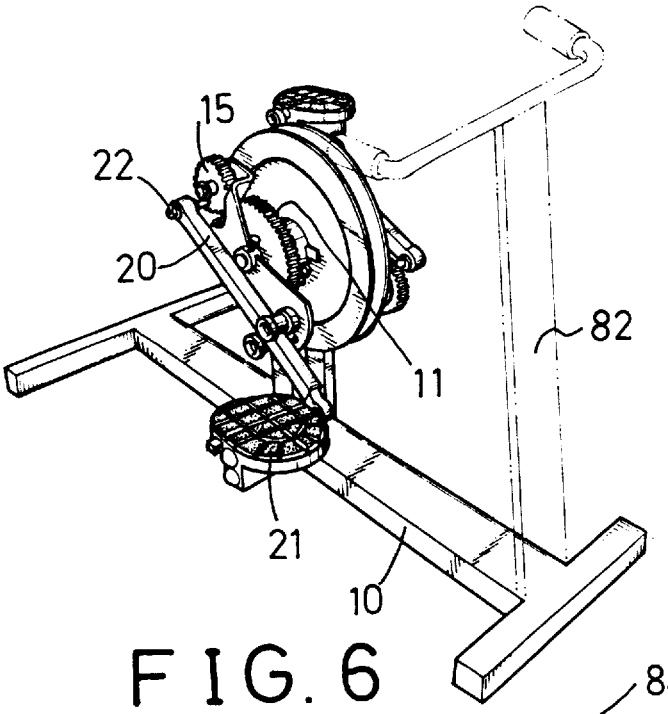
Figure 7:
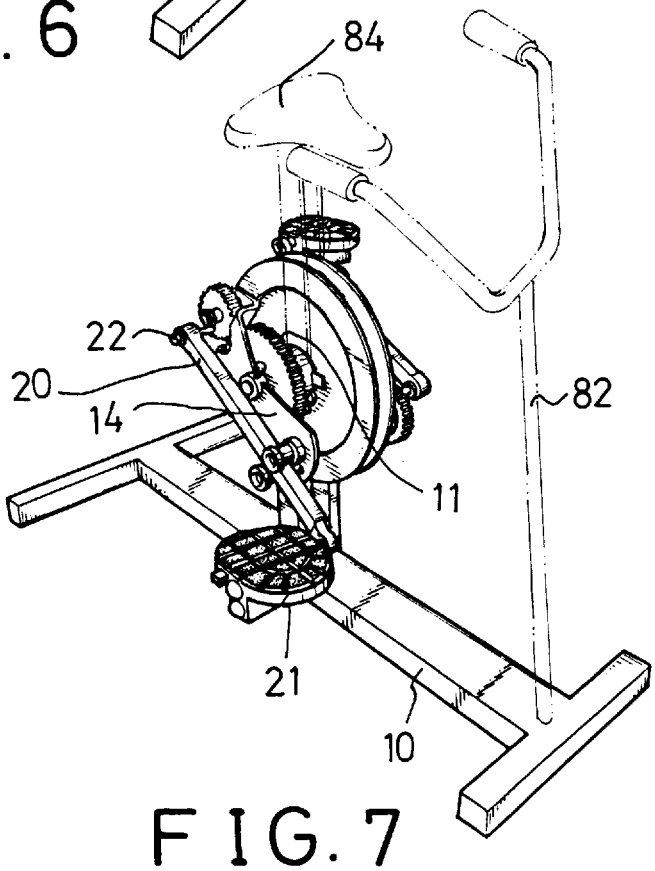

As shown in FIG. 5, the user may sit on a chair 80 for conducting the stepping exercise with the exerciser. As shown in FIG. 6, the exerciser may be provided with a handle 82 for supporting the upper portion of the user and for allowing the user to conduct a stepping exercise along an elliptical moving path. As shown in FIG. 7, in addition to the handle 82, a seat 84 may be provided for allowing the user to conduct a cycling exercise with an elliptical moving path.

Figure 8:
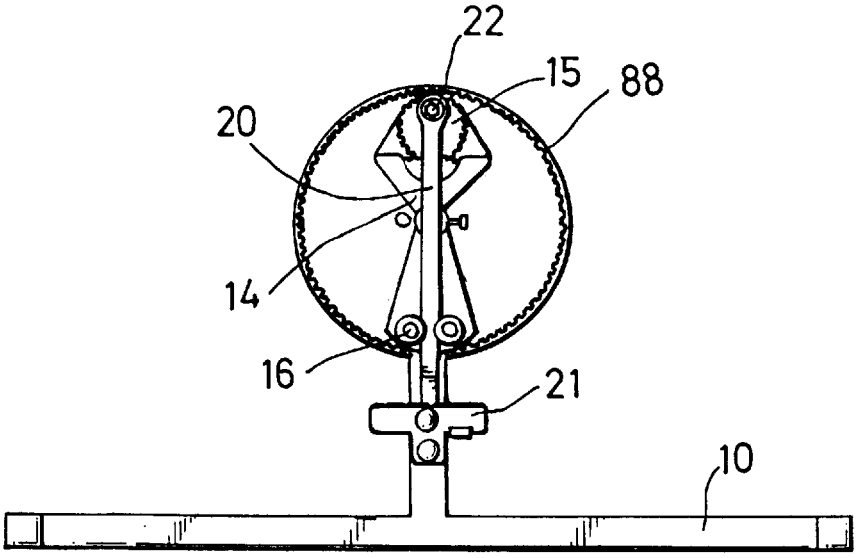
FIG. 8 is a side view illustrating another application of the exerciser.

As shown in FIG. 8, alternatively, a pair of internal gears 88 may be secured on the base 10 and engaged with the pinions 15 which may also move around the internal gears 88 for allowing the foot pedals 21 to move along an elliptical moving path. Further alternatively, the gears 11, 88 and the pinions 15 may be replaced by two large wheels and two small wheels that are rotated around the large wheels and engaged with the large wheels with force-fitted engagement.

As shown in the drawings, a weight 28 may be secured to the axle 12 for applying a momentum of inertia to the axle 12 and for applying a resistive force against the movement of the foot pedals 21. The weight 28 may further be coupled to a disc and/or a magnetic braking device may be applied to the weight 28 or the disc for applying a resistive force against the movement of the foot pedals 21.

Accordingly, the exerciser in accordance with the present invention includes a pair of foot supports that may be provided for allowing the user to conduct a stepping exercise along an elliptical moving path.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including an axle, a pair of plates rotatably secured to said axle and adapted to be rotated about said axle, a pair of foot supports slidably secured to said plates and adapted to be moved radially relative to said plates, said foot supports each including a first end having a foot pedal, and means for moving said foot supports radially relative to said plates, said foot pedals being moved along an elliptic moving path when said plates and said foot supports are rotated about said axle and when said foot supports are moved radially relative to said plates.

2. An exerciser according to claim 1, wherein said base includes a pair of first circular members secured thereon at said axle, said plates each includes a first end having a second circular member rotatably secured thereon at a pivot pin and engaged with said first circular member and adapted to be rotated around said first circular member, for allowing said second circular member to be rotated about said pivot pin when said second circular member is rotated around said first circular member, said foot supports each includes a second end pivotally coupled to said second circular member at an eccentric shaft for allowing said second end of said foot supports to be rotated around said eccentric shaft when said second circular member is rotated around said first circular member.

3. An exerciser according to claim 2, wherein said first circular member is a gear, and said second circular member is a pinion engaged with said gear.

4. An exerciser according to claim 2, wherein said first circular member is an internal gear, and said second circular member is a pinion engaged with said internal gear.

5. An exerciser according to claim 1, wherein said plates each includes a pair of rollers for slidably engaging with said foot supports.

6. An exerciser according to claim 1, wherein said base includes a handle for supporting an upper portion of a user.

* * * * *